US010927754B2

(12) United States Patent
Makartchouk

(10) Patent No.: US 10,927,754 B2
(45) Date of Patent: Feb. 23, 2021

(54) ENGINE HAVING A VARIABLE COMPRESSION RATIO

(71) Applicant: International Engine Intellectual Property Company, LLC, Lisle, IL (US)

(72) Inventor: Andrei Makartchouk, Hinsdale, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 0 days.

(21) Appl. No.: 16/259,650

(22) Filed: Jan. 28, 2019

(65) Prior Publication Data

US 2020/0240324 A1 Jul. 30, 2020

(51) Int. Cl.
*F02B 75/04* (2006.01)

(52) U.S. Cl.
CPC ..... *F02B 75/045* (2013.01)

(58) Field of Classification Search
CPC ..... F02B 75/045; F02B 75/048; F02B 75/04; F02B 75/32; F16H 21/32; Y10T 74/2142; F02D 15/02
USPC ..... 123/48 B
See application file for complete search history.

(56) References Cited

U.S. PATENT DOCUMENTS

| | | | | |
|---|---|---|---|---|
| 7,334,547 | B2 * | 2/2008 | Hiraya | F01L 1/022 123/48 B |
| 2001/0017112 | A1 * | 8/2001 | Moteki | F02B 75/045 123/78 R |
| 2001/0039929 | A1 * | 11/2001 | Arai | F02B 75/048 123/48 R |
| 2008/0173281 | A1 * | 7/2008 | Jurging | F02B 75/04 123/48 B |
| 2009/0038588 | A1 * | 2/2009 | Hiyoshi | F02B 75/048 123/48 B |
| 2009/0107454 | A1 | 4/2009 | Hiyoshi | |
| 2015/0167577 | A1 | 6/2015 | Zukouski | |

* cited by examiner

*Primary Examiner* — George C Jin
*Assistant Examiner* — Teuta B Holbrook
(74) *Attorney, Agent, or Firm* — Jack D. Nimz; Jeffrey P. Calfa

(57) ABSTRACT

A compression ratio varying mechanism of an engine includes an upper link connected to the piston, and a lower link connected to the crankshaft and to the upper link. A control link is connected to the lower end of the upper link and/or to the upper end of the lower link. A lever arm is connected to a lever control shaft, and is controlled in its orientation thereby. The control link is connected to the lever arm, and is substantially the same length as the lever arm. The crankpin offset, the length of the lower link, and the position of the lever control shaft are such that the position of the connection between the control link and the upper and lower links coincides with the position of the lever control shaft at the Bottom Dead Center position of the piston and crankshaft.

17 Claims, 5 Drawing Sheets

ENGINE HAVING A VARIABLE COMPRESSION RATIO

BACKGROUND

This disclosure relates to engines, and in particular to engines for commercial ground vehicles, in which the compression ratio may be varied in order to improve overall efficiency. Further, it relates to such an engine that provides a variable compression ratio without sacrificing overall expansion volume of the cylinder, and a method for the use thereof.

RELATED ART

Technical data illustrates that fuel efficiency of engines having the capability to provide a variable compression ratio are higher than engines having a fixed compression ratio. It is known that engines having the capability to provide a variable compression ratio may achieve increases in fuel efficiency of between 18 and 27 percent. However, known engines having the capability to provide a variable compression ratio also require several additional joints in the linkage between the crankshaft and the piston. Each such joint adds to the manufacturing complexity of the engine, increases the number of potential failure points of the linkage, and increases the overall friction of the linkage. Furthermore, known engines having the capability to provide a variable compression ratio also vary the maximum cylinder volume available for expansion of combustion gases as a function of the variability of the bottom dead center location of the piston. Therefore, known engines having the capability to provide a variable compression ratio fail to take full advantage of the full available expansion volume of the engine and limit the overall expansion ratio, often when the compression ratio is at its highest, thereby limiting efficiency Accordingly, there is an unmet need for an arrangement and method for varying the compression ratio of an engine while reducing the number of additional joints in the linkage between the crankshaft and the piston. There is also an unmet need for an arrangement and method for varying the compression ratio of an engine without substantially affecting the maximum available expansion volume, thereby taking full advantage of the available expansion volume of the engine and maximizing the overall expansion ratio, in order to maximize overall efficiency.

SUMMARY

According to one embodiment of the Engine Having a Variable Compression Ratio, a vehicle has an engine. The engine includes a piston arranged within a cylinder and a crankshaft having a crankpin offset from the centerline of the crankshaft. A compression ratio varying mechanism includes a first or upper link with an upper end and a lower end, which is connected at its upper end to the piston. The compression ratio varying mechanism further includes a second or lower link with an upper end and a lower end, which is connected at its lower end to the crankpin and at its upper end to the lower end of the first or upper link. The compression ratio varying mechanism further includes a third or control link with a first end and a second end, which is connected at its first end to the lower end of the first or upper link and/or to the upper end of the second or lower link. The compression ratio varying mechanism further includes a lever arm with a first end and a second end, which is connected at its first end to a lever control shaft, and which is controlled in its orientation thereby. The third or control link is connected at its second end to the second end of the lever arm. The third or control link is substantially the same length as the lever arm.

According to another embodiment of the Engine Having a Variable Compression Ratio, an engine of a vehicle has a piston arranged within a cylinder and a crankshaft having a crankpin offset from the centerline of the crankshaft. A compression ratio varying mechanism includes a first or upper link with an upper end and a lower end, which is connected at its upper end to the piston. The compression ratio varying mechanism further includes a second or lower link with an upper end and a lower end, which is connected at its lower end to the crankpin and at its upper end to the lower end of the first or upper link. The compression ratio varying mechanism further includes a third or control link with a first end and a second end, which is connected at its first end to the lower end of the first or upper link and/or to the upper end of the second or lower link. The compression ratio varying mechanism further includes a lever arm with a first end and a second end, which is connected at its first end to a lever control shaft, and which is controlled in its orientation thereby. The third or control link is connected at its second end to the second end of the lever arm. The third or control link is substantially the same length as the lever arm.

According to another embodiment of the Engine Having a Variable Compression Ratio, a method for varying the compression ratio of an engine includes several steps. The first step is arranging a piston within a cylinder. The second step is providing a crankshaft with a crankpin offset from the centerline of the crankshaft. The third step is connecting a first or upper link at its upper end to the piston. The fourth step is connecting a second or lower link at its lower end to the crankpin and at its upper end to the lower end of the first or upper link. The fifth step is connecting a third or control link at its first end to the lower end of the first or upper link and/or to the upper end of the second or lower link. The sixth step is connecting a lever arm at its first end to a lever control shaft, and controlling its orientation thereby. The seventh step is connecting the third or control link at its second end to the second end of the lever arm. The eighth step is configuring the third or control link to be substantially the same length as the lever arm.

Figure 1:
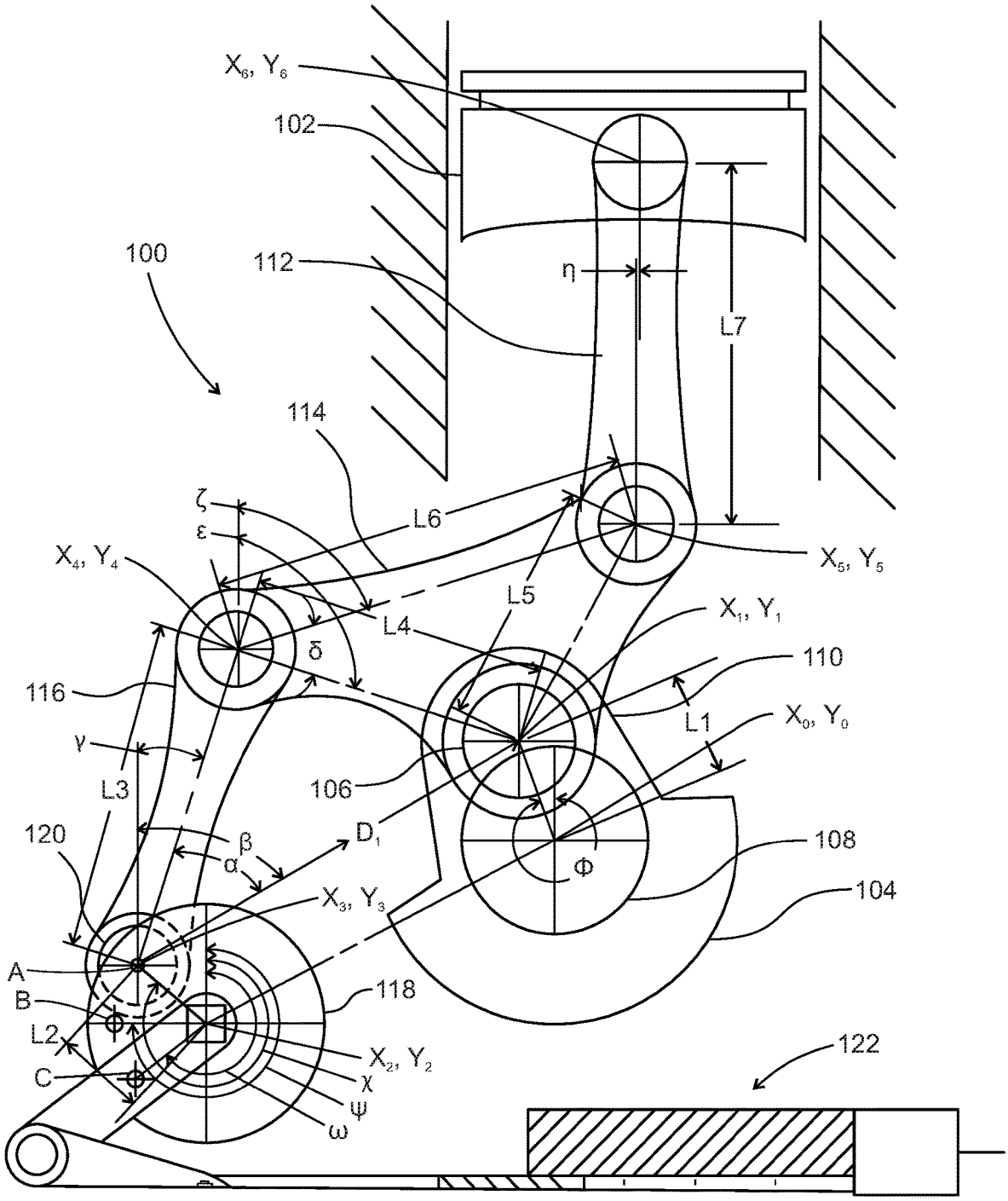
FIG. 1 is an end view of a known multi-link variable compression ratio engine, as described herein.

DESCRIPTION—ENGINE HAVING A VARIABLE COMPRESSION RATIO ACCORDING TO THE PRESENT DISCLOSURE

Embodiments described herein relate to an Engine Having a Variable Compression Ratio and methods for the use thereof. The engine and its method of use may be applied to engines used in various types of stationary applications, marine applications, passenger vehicles, and commercial vehicles and recreational vehicles, such as highway or semi-tractors, straight trucks, busses, fire trucks, agricultural vehicles, motorhomes, rail travelling vehicles, and etcetera. It is further contemplated that embodiments of the Engine Having a Variable Compression Ratio and methods for the use thereof may be applied to engines configured for various fuels, such as gasoline, diesel, propane, natural gas, and hydrogen, as non-limiting examples. The several embodiments of the Engine Having a Variable Compression Ratio and method for the use thereof presented herein are employed on vehicles utilizing the Otto cycle or the Diesel cycle, but this is not to be construed as limiting the scope of the engine and its method of use, which may be applied to engines of differing construction.

Embodiments of the Engine Having a Variable Compression Ratio and methods for the use thereof disclosed herein vary the compression ratio of the engine by varying the Top Dead Center (TDC) position of the piston while utilizing a minimum of additional joints in the linkage between the crankshaft and the piston. By controllably adjusting the compression ratio, embodiments of the Engine Having a Variable Compression Ratio of the present disclosure increase their overall fuel efficiency as compared to engines of conventional construction. This results in reduced fuel consumption and reduced Green House Gas (GHG) emissions. Embodiments of the Engine Having a Variable Compression Ratio further vary the compression ratio of the engine by varying the Top Dead Center (TDC) position of the piston while keeping the Bottom Dead Center (BDC) position of the piston at substantially the same vertical location, thereby maximizing the cylinder volume available for expansion of combustion gases regardless of the compression ratio used. This allows embodiments of the Engine Having a Variable Compression Ratio of the present disclosure to take advantage of the full available expansion volume of the engine cylinders, thereby maximizing efficiency. Keeping the BDC position at substantially the same vertical location may be defined in this context as keeping the BDC position sufficiently the same so that any variation is insufficient to affect efficiency of the engine to a greater extent than normal performance variation due to manufacturing variation or operating conditions, for a given TDC piston position setting of the compression ratio varying mechanism.

Embodiments of the Engine Having a Variable Compression Ratio of the present disclosure utilize a first or upper link connected to a second or lower link in lieu of a single connecting rod between the piston and crankshaft. Specifically, the second or lower link is connected to the crankpin of the crankshaft at its lower end. The first or upper link is connected to the piston at its upper end, and to the second or lower link at its lower end. A third or control link has a common connection with the connection point between the first or upper link and the second or lower link, and is used to control the position of the connection point between the first or upper link and the second or lower link. The third or control link is connected at its opposite end to a lever arm, which in turn pivots about a lever arm pivot point and is controlled in its orientation by a lever control shaft. The lever control shaft is in turn controlled by a lever shaft control mechanism under the control of one or more controllers. The lever shaft control mechanism may be any suitable mechanism for controllably rotating a shaft, such as a stepper motor, a worm drive, a gear drive, a linear actuator and crank, and etcetera.

As the lever arm pivots about the lever arm pivot point under the control of the lever control shaft and lever shaft control mechanism, the arcuate motion of the connection between the third or control link and the lever arm repositions the center of rotation of the third or control link. As a result, the angle between the first or upper link and the second or lower link through the upper part of its reciprocal motion may be increased or decreased. In this way, the TDC position of the piston relative to the cylinder may be altered. However, the length of the third or control link is chosen to be substantially the same as the length of the lever arm. Substantially the same length in this context may be defined as being sufficiently the same length so that any variation in length is insufficient to affect efficiency of the engine to a greater extent than normal performance variation due to manufacturing variation or operating conditions, for a given TDC piston position setting of the compression ratio varying mechanism.

Furthermore, the length of the crankpin offset from the crankshaft centerline, the length of the second or lower link, and the position of the lever pivot point relative to the position of the crankshaft are chosen so that the position of the connection between the first or upper link, the second or lower link, and the third or control link substantially coincides with the position of the lever pivot point at the BDC position of the piston and crankshaft. Substantially coincides with the position of the lever pivot point in this context may be defined as being sufficiently the same position so that any variation in position is insufficient to affect efficiency of the engine to a greater extent than normal performance variation due to manufacturing variation or operating conditions, for a given TDC piston position setting of the compression ratio varying mechanism. In this way, the BDC position of the piston relative to the cylinder remains substantially the same regardless of the angle of the lever control shaft and lever arm. Even more particularly, the position of the lever pivot point, as defined by the position of the lever control shaft, may be chosen so that the position of the connection between the first or upper link, the second or lower link, and the third or control link that is coincident with the position of the lever pivot point when the piston and crankshaft is at BDC is offset to one side of the centerline of the crankshaft, and so that the are described by the connection between the third or control link and the lever arm is to the other side of the centerline of the crankshaft.

DETAILED DESCRIPTION—KNOWN COMPRESSION RATIO VARYING MECHANISM

Referring initially to FIG. 1, a known compression ratio varying mechanism 100 of a multilink variable compression ratio engine is shown. The known compression varying mechanism 100 includes a piston 102 connected to a crankpin 106 of a crankshaft 104 by way of an upper link 112 and a lower link 114. The crankpin 106 is connected to crank arms 110 of the crankshaft 104 and is thereby offset from the centerline of the crankshaft 104 by the length L1 of the crank arms 110. The crankshaft 104 rotates in journal 108, which serves to fix the location of the centerline of the crankshaft 104. The compression ratio varying mechanism 100 is arranged to vary the TDC position of the piston 102 in order to vary the compression ratio of the engine. In addition to the upper link 112 and the lower link 114, the compression ratio varying mechanism 100 further includes a control link 116, which is used to vary the compression ratio of the engine by controlling the orientation of the lower link 114, which oscillates around the crankpin 106 which serves as a center axis for the lower link 114.

The top end of the control link 116 of the known compression ratio varying mechanism 100 is rotatably connected to the lower link 114 and the bottom end of the control link 116 is connected to a control eccentric 120 of a control shaft 118. The control shaft 118 is disposed substantially parallel to the crankshaft 104, and is supported in a rotatable manner on the engine body. The control eccentric 120 is offset from the centerline of the control shaft 118 by length L2. By rotating the control shaft 118, a shaft control mechanism 122, which is shown in partiality, raises and lowers the control link 116, thereby controlling the orientation of the lower link 114 and varying the TDC position of the piston 102 in order to vary the compression ratio of the engine. A controller (not shown) may control the shaft control mechanism 122 in order to vary the compression ratio in accordance with the operating state of the engine.

When the shaft control mechanism 122 of the known compression ratio varying mechanism 100 turns the control shaft 118 counterclockwise, the position of the control eccentric 120 to which the control link 116 is connected is thereupon lowered. When the control eccentric 120 is thus lowered, the lower link 114 tilts counterclockwise around the crankpin 106, raising the position of the connection between the lower link 114 and the upper link 112, and the TDC position of the piston 102 therefore rises, increasing the compression ratio. However, the BDC position of the piston 102 also rises, decreasing the maximum volume of the cylinder available for expansion of combustion gases. Conversely, when the shaft control mechanism 122 turns the control shaft 118 clockwise, the position of the control eccentric 120 thereupon rises, the lower link 114 tilts clockwise, and the position of the connection between the lower link 114 and the upper link 112 is lowered. Therefore, the BDC position of the piston 102 is also lowered, increasing the maximum volume of the cylinder available for expansion of combustion gases, but also decreasing the compression ratio.

Therefore, the known compression ratio varying mechanism 100 varies the compression ratio, but also varies the maximum cylinder volume available for expansion of combustion gases as a function of the variability of the BDC location of the piston. When the compression ratio of the known compression ratio varying mechanism 100 is at its highest, the maximum cylinder volume is also at its lowest. When compression ratio of the known compression ratio varying mechanism 100 is at its lowest, the maximum cylinder volume is also at its highest. Therefore, the known compression ratio varying mechanism 100 fails to take full advantage of the available expansion volume of the engine and limits the overall expansion ratio when the compression ratio is at its highest, thereby limiting efficiency.

To demonstrate this characteristic of the known compression ratio varying mechanism 100, applicant has calculated and plotted the piston 102 location relative to the crankshaft 104 for each of three control eccentric 120 positions, A, B, and C. This is accomplished by setting the crankshaft 104 location to $X_0$, $Y_0$=(0, 0) and scaling the crank arm 110 length L1 to two inches. Then crankpin 106 location $X_1$, $Y_1$ is determined as a function of crankshaft 104 angle φ in ten degree increments and as a function of crank arm 110 length L1 (2.00"):

$$X_1=L1\times\sin\varphi$$

$$Y_1=L1\times\cos\varphi$$

Control eccentric 120 location $X_3$, $Y_3$ is then determined for each of control eccentric 120 angles χ (345°), ψ (280°), and ω (220°) of control eccentric 120 positions A, B, and C respectively, as a function of given control shaft 118 location $X_2$, $Y_2$ (−6.58", −3.44") and control eccentricity L2 (1.75").

$$X_3^{A,B,C}=X_2+L2\times\sin\chi,\psi,\omega$$

$$Y_3^{A,B,C}=Y_2+L2\times\cos\chi,\psi,\omega$$

The distance D1 between the crankpin 106 location $X_1$, $Y_1$ and the control eccentric 120 location $X_3$, $Y_3$ is then determined for each of control eccentric 120 positions A, B, and C.

$$D_1^{A,B,C}=\sqrt{((X_1-X_3^{A,B,C})^2+(Y_1-Y_3^{A,B,C})^2)}$$

The included angle α between the line from the control eccentric 120 to the crankpin 106 and the control link 116 is then determined as a function of the distance D1, the control link 116 length L3 (6.17"), and the lower link 114 length L4 (5.57") from the crankpin 106 to the control link 116, for each of positions A, B, and C.

$$\alpha^{A,B,C}=a\cos((L3^2+D_1^{(A,B,C)})^2-L4^2)/(2\times L3\times D_1^{A,B,C}))$$

The angle β of the line from the control eccentric 120 to the crankpin 106 is then determined for each of control eccentric 120 positions A, B, and C.

$$\beta^{A,B,C}=90-a\tan((Y_1-Y_3^{A,B,C})/(X_1-X_3^{A,B,C}))$$

The angle γ of the control link 116 is then determined for each of control eccentric 120 positions A, B, and C.

$$\gamma^{A,B,C}=\beta^{A,B,C}-\alpha^{A,B,C}$$

The location $X_4$, $Y_4$ of the control link 116 connection to the lower link 114 is then determined as a function of the control eccentric 120 positions A, B, and C, the control link 116 length L3, and the angle γ of the control link 116, for each of control eccentric 120 positions A, B, and C.

$$X_4^{A,B,C}=X_3^{A,B,C}+L3\times\sin\gamma^{A,B,C}$$

$$Y_4^{A,B,C}=Y_3^{A,B,C}+L3\times\cos\gamma^{A,B,C}$$

The included angle δ of the lower link 114 between the line from the lower link 114 connection to the control link 116 to the lower link 114 connection to the crankpin 106 and the line from the lower link 114 connection to the control link 116 to the lower link 114 connection to the upper link 112 is determined as a function of the lower link 114 length L4 from the crankpin 106 to the control link 116, the lower link 114 length L5 (4.63") from the crankpin 106 to the upper link 112, and the lower link 114 length L6 (7.81") from the control link 116 to the upper link 112.

$$\delta=a\cos((L4^2+L6^2=L5^2)/(2\times L4\times L6))$$

Next, the angle ε of the line from the lower link 114 connection to the control link 116 to the lower link 114 connection to the crankpin 106 is determined as a function of the location $X_4$, $Y_4$ of the control link 116 connection to the lower link 114 and of crankpin 106 location $X_1$, $Y_1$, for each of control eccentric 120 positions A, B, and C.

$$\varepsilon^{A,B,C}=90+a\tan((Y_4^{A,B,C}-Y_1)/(X_4^{A,B,C}-X_1))$$

Then the included angle δ of the lower link 114 is subtracted from the angle ε to get the angle ζ of the line from the lower link 114 connection to the control link 116 to the lower link 114 connection to the upper link 112, for each of control eccentric 120 positions A, B, and C.

$$\zeta^{A,B,C}=\varepsilon^{A,B,C}-\delta$$

The location $X_5$, $Y_5$ of the lower link 114 connection to the upper link 112 is then determined as a function of location $X_4$, $Y_4$ of the control link 116 connection to the lower link 114, of the lower link 114 length L6 from the control link 116 to the upper link 112, and of angle ζ, for each of control eccentric 120 positions A, B, and C.

$$X_5^{A,B,C}=X_4^{A,B,C}+L6\times\cos(90-\zeta^{A,B,C})$$

$$Y_5^{A,B,C}=Y_4^{A,B,C}+L6\times\sin(90-\zeta^{A,B,C})$$

Next, the angle η of the upper link 112 is determined as a function of the cylinder offset COF (1.55") from the crankshaft 104 journal 105, of the location $X_5$, $Y_5$ of the lower link 114 connection to the upper link 112, and of the upper link 112 length L7 (6.79"), for each of control eccentric 120 positions A, B, and C.

$$\eta^{A,B,C}=a\sin((COF-X_5^{A,B,C})/L7)$$

Finally, the vertical location $Y_6$ of the upper link 112 connection to the piston 102 is determined as a function of the vertical location $Y_5$ of the lower link 114 connection to the upper link 112, of the upper link 112 length L7, and of the angle η of the upper link 112, for each of control eccentric 120 positions A, B, and C.

$$Y_6^{A,B,C}=Y_5^{A,B,C}+L7\times\cos\eta^{A,B,C}$$

Figure 2:
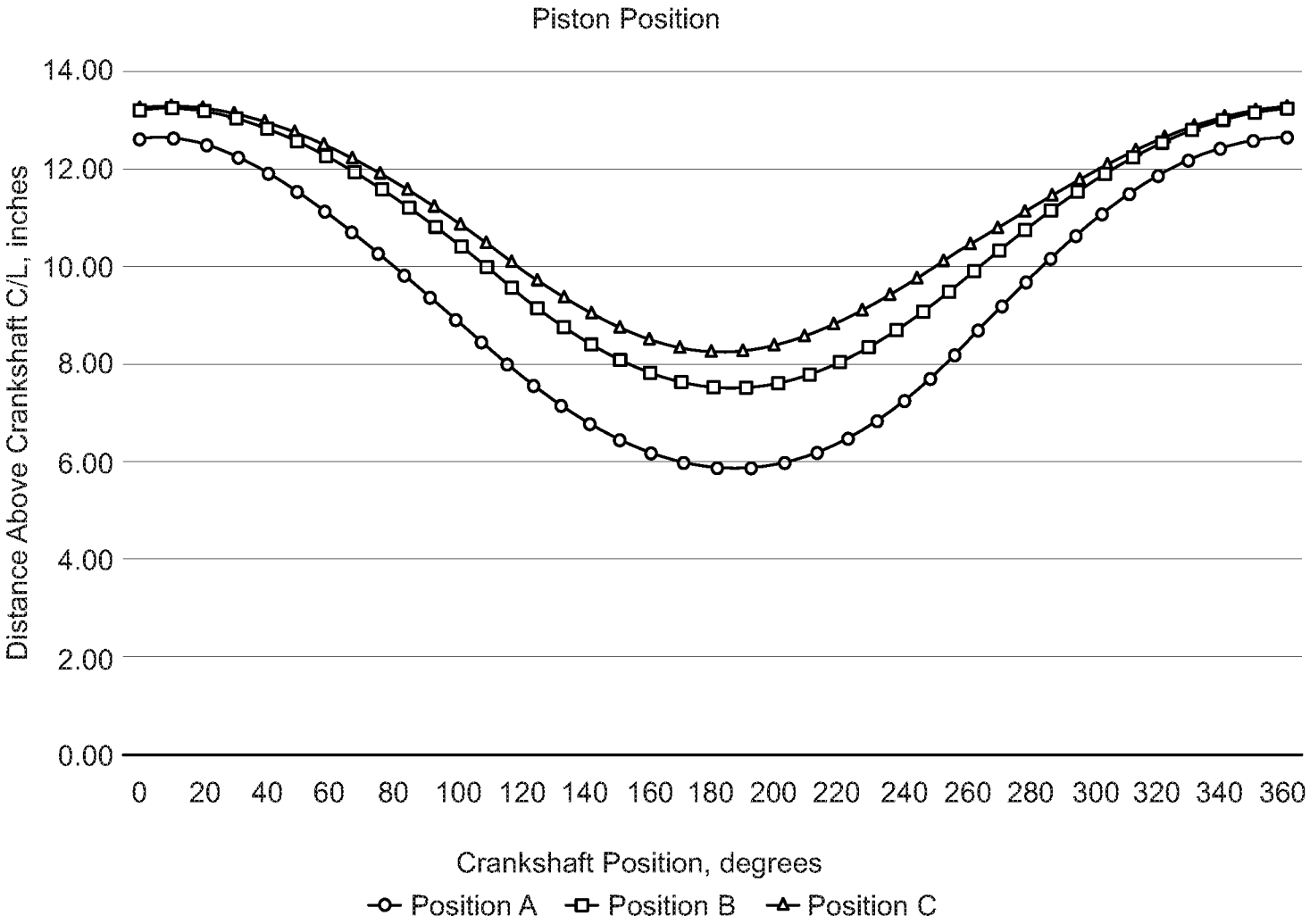
FIG. 2 is a graph of the piston position as a function of the crankshaft position for each of three positions of the control shaft and eccentric of the known multi-link variable compression ratio engine of FIG. 1, as described herein.
Figure 3:
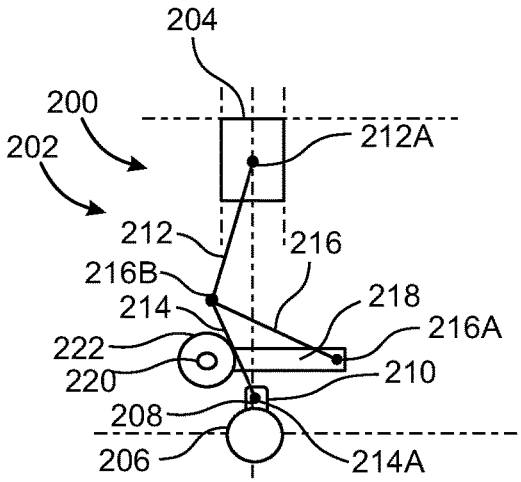
FIG. 3 is an end view of an embodiment of a compression ratio varying mechanism of the Engine Having a Variable Compression Ratio of the present disclosure, as described herein.
Figure 4:
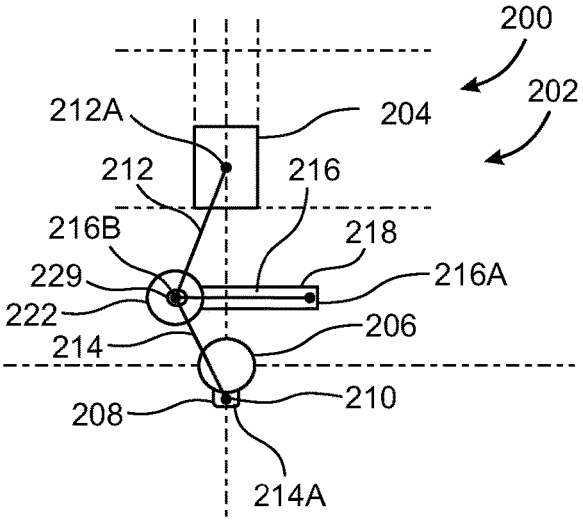
FIG. 4 is an end view of an embodiment of a compression ratio varying mechanism of the Engine Having a Variable Compression Ratio of the present disclosure, as described herein.
Figure 5:
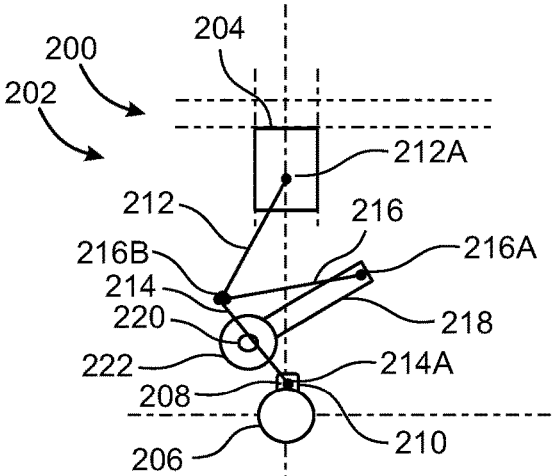
FIG. 5 is an end view of an embodiment of a compression ratio varying mechanism of the Engine Having a Variable Compression Ratio of the present disclosure, as described herein.
Figure 6:
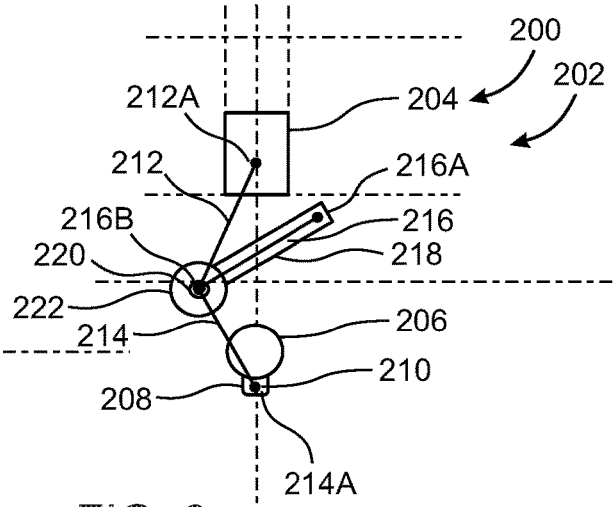
FIG. 6 is an end view of an embodiment of a compression ratio varying mechanism of the Engine Having a Variable Compression Ratio of the present disclosure, as described herein.
Figure 7:
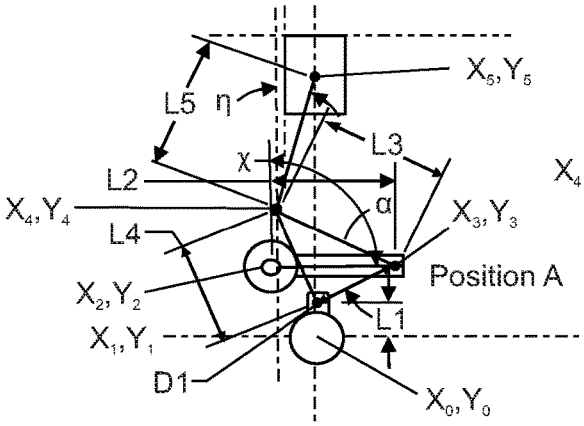
FIG. 7 is an end view of an embodiment of a compression ratio varying mechanism of the Engine Having a Variable Compression Ratio of the present disclosure, as described herein.
Figure 8:
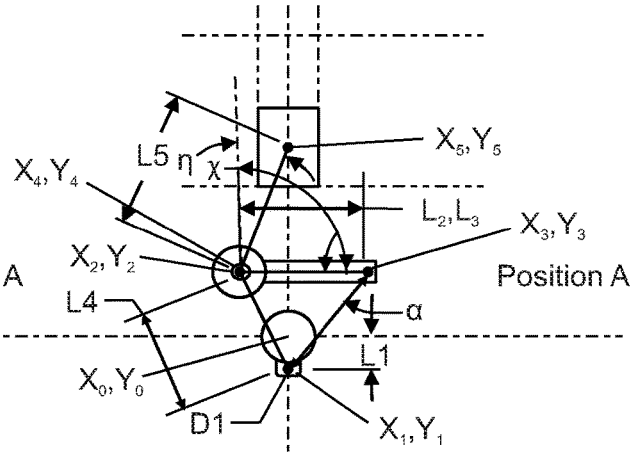
FIG. 8 is an end view of an embodiment of a compression ratio varying mechanism of the Engine Having a Variable Compression Ratio of the present disclosure, as described herein.
Figure 9:
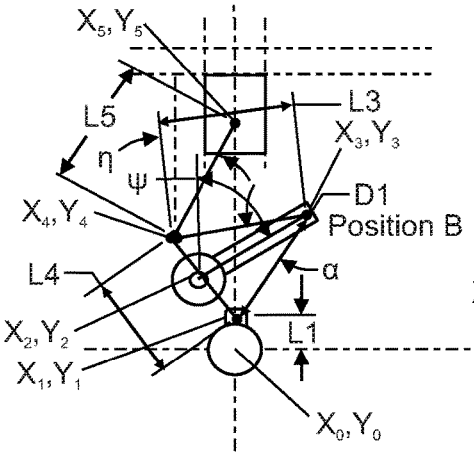
FIG. 9 is an end view of an embodiment of a compression ratio varying mechanism of the Engine Having a Variable Compression Ratio of the present disclosure, as described herein.
Figure 10:
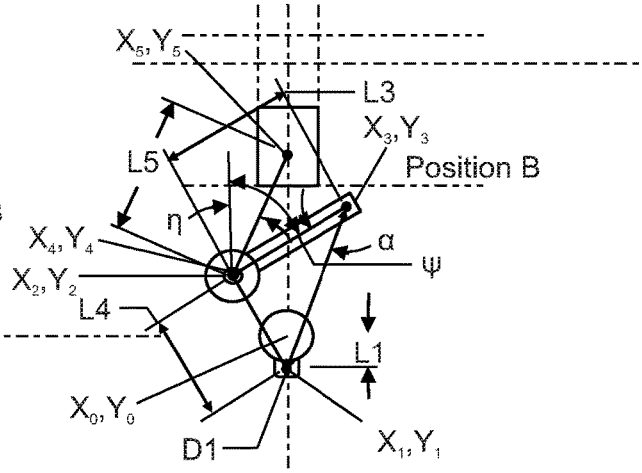
FIG. 10 is an end view of an embodiment of a compression ratio varying mechanism of the Engine Having a Variable Compression Ratio of the present disclosure, as described herein.

FIG. 2, therefore, shows a plot of the piston 102 position of the known compression ratio varying mechanism 100 in vertical inches above the crankshaft 104 centerline, for each of control eccentric 120 positions A, B, and C. As noted previously, the known compression ratio varying mechanism 100 varies the compression ratio, but also varies the maximum cylinder volume available for expansion of combustion gases as a function of the variability of the BDC location of the piston, as shown. Therefore, the known compression ratio varying mechanism 100 fails to take full advantage of the available expansion volume of the engine and limits the overall expansion ratio when the compression ratio is at its highest, thereby limiting efficiency.

DETAILED DESCRIPTION—ENGINE HAVING A VARIABLE COMPRESSION RATIO ACCORDING TO THE PRESENT DISCLOSURE

Embodiments of the Engine Having a Variable Compression Ratio 200 according to the present disclosure, however, vary the compression ratio of the engine cylinders without affecting maximum available expansion volume. Turning now to FIGS. 3, 4, 5, and 6, an embodiment of an Engine Having a Variable Compression Ratio 200 according to the present disclosure is shown in several positions. The Engine Having a Variable Compression Ratio 200 includes a compression ratio varying mechanism 202 having a piston 204 connected to a crankpin 208 of a crankshaft 206 by way of a first or upper link 212 and a second or lower link 214. The first or upper link 212 is connected to the piston 204 by way of first or upper link connection to piston 212A. The second or lower link 214 is connected to the crankpin 208 by way of second or lower link connection to crankpin 214A. The crankpin 208 is again connected to crank arms 210 of the crankshaft 206, and is thereby offset from the centerline of the crankshaft 206 by the length L1 of the crank arms 210.

The first or upper link 212 of the compression ratio varying mechanism 202 of the Engine Having a Variable Compression Ratio 200 of the present disclosure is connected to the second or lower link 214, and also to a third or control link 216 at a common connection between first or upper link, second or lower link, and third or control link 216B. The opposite end of the third or control link 216 is connected to a lever arm 218 by way of a third or control link connection to lever 216A. The lever arm 218 pivots about a lever pivot point 220 and is connected to and controlled by a lever control shaft 222. By rotating the lever control shaft 222, a lever shaft control mechanism (not shown) raises and lowers the third or control link connection to lever 216A, thereby varying the TDC position of the piston 204 in order to vary the compression ratio of the engine. A controller (not shown) may control the shaft control mechanism in order to vary the compression ratio in accordance with the operating state of the engine.

When the shaft control mechanism of the compression ratio varying mechanism 202 of the Engine Having a Variable Compression Ratio 200 of the present disclosure turns the lever control shaft 222 counterclockwise, the position of the third or control link connection to lever 216A is raised and is closer to the centerline of the crankshaft 206 and of the piston 204. As a result, when the crankshaft 206 is at zero degrees with the crankpin 208 at its uppermost position, there is a greater angle between the first or upper link 212 and the second or lower link 214. In this way, the TDC position of the piston 204 is lowered, and the compression ratio of the engine is reduced. Because the length of the third or control link 216 is the same or substantially the same as the length of the lever arm 218, and by virtue of the chosen length of the second or lower link 214, when the crankshaft 206 is at 180 degrees with the crankpin 208 at its lowermost position, the location of the connection between first or upper link, second or lower link, & third or control link 216B corresponds with the location of the lever pivot point 220.

When the shaft control mechanism of the compression ratio varying mechanism 202 of the Engine Having a Variable Compression Ratio 200 of the present disclosure turns the lever control shaft 222 clockwise, the position of the third or control link connection to lever 216A is lowered and is further from the centerline of the crankshaft 206 and of the piston 204. As a result, when the crankshaft 206 is at zero degrees with the crankpin 208 at its uppermost position, there is a lesser angle between the first or upper link 212 and the second or lower link 214. In this way, the TDC position of the piston 204 is raised, and the compression ratio of the engine is increased. Nevertheless, because the length of the third or control link 216 is the same or substantially the same as the length of the lever arm 218, and by virtue of the chosen length of the second or lower link 214, when the crankshaft 206 is at 180 degrees with the crankpin 208 at its lowermost position, the location of the connection between first or upper link, second or lower link, and third or control link 216B still corresponds with the location of the lever pivot point 220.

In this way, the BDC position of the piston 204 remains substantially the same whether the compression ratio of the Engine Having a Variable Compression Ratio 200 of the present disclosure is at its highest or is at its lowest. Therefore, the Engine Having a Variable Compression Ratio 200 of the present disclosure takes full advantage of the available expansion volume of the engine and maximizes the overall expansion ratio regardless of the compression ratio used.

Turning now to FIGS. 7, 8, 9, and 10, applicant has calculated and plotted the piston 202 location relative to the crankshaft 206 for each of lever arm 218 positions A and B. This is accomplished by setting the crankshaft 206 centerline location to $X_0$, $Y_0$=(0, 0) and setting the crank arm 210 length L1 to two inches. Then crankpin 208 location $X_1$, $Y_1$ is determined as a function of crankshaft 206 angle cp in ten degree increments and as a function of crank arm 210 length L1 (2.00"):

$$X_1=L1\times\sin\varphi$$

$$Y_1=L1\times\cos\varphi$$

Third or control link connection to lever 216A location $X_3$, $Y_3$ is then determined for each of lever arm 218 positions A and B as a function of given lever control shaft 222 and lever pivot point 220 location $X_2$, $Y_2$ (−3.07", −3.91"), lever arm 218 length L2 (7.86"), and lever arm 218 angles χ (90°) and ψ (60°) for lever arm 218 positions A and B, respectively.

$$X_3^{A,B}=X_2+L2\times\sin\chi,\psi$$

$$Y_3^{A,B}=Y_2+L2\times\sin\chi,\psi$$

The distance D1 between the crankpin 208 location $X_1$, $Y_1$ and the third or control link connection to lever 216A location $X_3$, $Y_3$ is determined for each of lever arm 218 positions A and B.

$$D_1^{A,B}=\sqrt{((X_3^{A,B}-X_1)^2+(Y_3^{A,B}-Y_1)^2)}$$

The included angle α between the third or control link 216 and the line from the third or control link connection to lever 216A to the crankpin 208 is then determined as a function of the distance D1, the third or control link 216 length L3 (7.86"), and the second or lower link 214 length L4 (6.60"), for each of lever arm 218 positions A and B. By design, third or control link 216 length L3 is the same as lever arm 218 length L2.

$$\alpha^{A,B}=a\cos((L3^2+(D_1^{A,B})^2-L4^2)/(2\times L3\times D_1^{A,B}))$$

The location $X_4$, $Y_4$ of the connection between first or upper link, second or lower link, and third or control link 216B is then determined as a function of the third or control link connection to lever 216A location $X_3$, $Y_3$, crankpin 208 location $X_1$, $Y_1$, the length L3 of the third or control link 216, and the included angle α, for each of lever arm 218 positions A and B.

$$X_4^{A,B}=X_3^{A,B}+L3\times\sin(a\tan((X_3^{A,B}-X_1)/(Y_3A,B-Y_1))+\alpha^{A,B}-180)$$

$$Y_4^{A,B}=Y_3^{A,B}+L3\times\cos(a\tan((X_3^{A,B}-X_1)/(Y_3A,B-Y_1))+\alpha^{A,B}-180)$$

Next, the angle η of the first or upper link 212 is determined as a function of the location $X_4$, $Y_4$ of the connection between first or upper link, second or lower link, and third or control link 216B, of the crankshaft 206 centerline location $X_0$, $Y_0$, of the cylinder offset (0.00"), and of the first or upper link 212 length L5 (8.10"), for each of lever arm 218 positions A and B.

$$\eta^{A,B}=a\sin((X_0-X_4^{A,B})/L5)$$

Finally, the vertical location $Y_5$ of the first or upper link connection to the piston 212A is determined as a function of the vertical location $Y_4$ of the connection between first or upper link, second or lower link, and third or control link 216B, of the first or upper link 212 length L5, and of the angle 1*t* of the first or upper link 212, for each of lever arm 218 positions A and B.

$$Y_5^{A,B}=Y_4^{A,B}+L5\times\cos\eta^{A,B}$$

Figure 11:
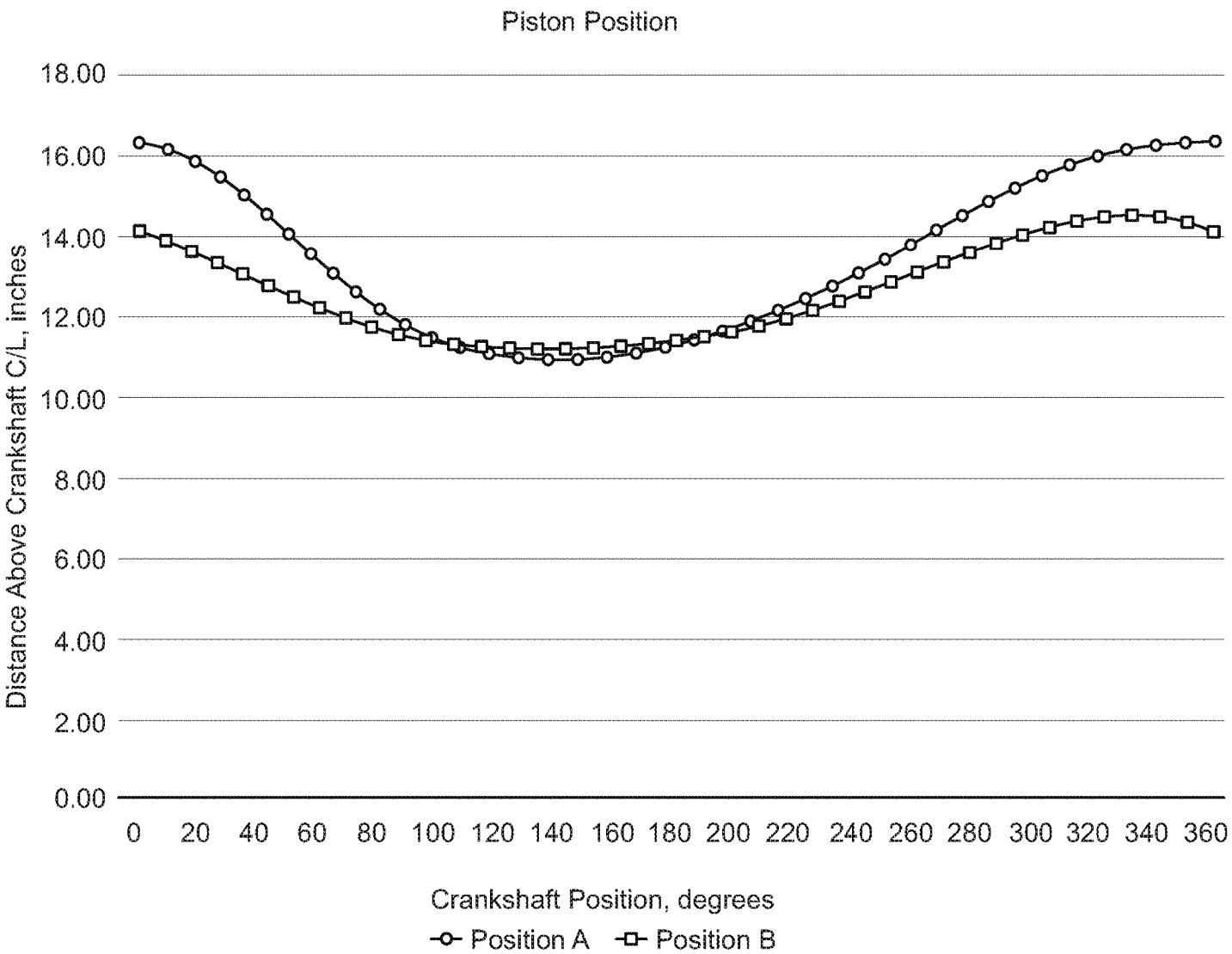
FIG. 11 is a graph of the piston position as a function of the crankshaft position for each of two positions of the lever control shaft and lever arm of an embodiment of a compression ratio varying mechanism of the Engine Having a Variable Compression Ratio of the present disclosure, as described herein

FIG. 11, therefore, shows a plot of the position of the first or upper link connection to the piston 212A of the Engine Having a Variable Compression Ratio 200 of the present disclosure in vertical inches above the crankshaft 206 centerline, for each of lever arm 218 positions A and B. It is noted that each of the crank arm 210 length L1, the lever arm 218 length L2, the third or control link 216 length L3, the second or lower link 214 length L4, the first or upper link 212 length L5, the lever pivot point 220 location $X_2$, $Y_2$, the lever arm 218 angles χ (90°) and ψ (60°) for lever arm 218 positions A and B, and the cylinder offset are somewhat arbitrary, so that each of the aforementioned lengths or locations may be different while remaining within the scope of the Engine Having a Variable Compression Ratio 200, except that third or control link 216 length L3 must be substantially the same as lever arm 218 length L2.

As noted previously, and as shown in FIG. 11, the Engine Having a Variable Compression Ratio 200 of the present disclosure varies the compression ratio without substantially affecting the maximum available expansion volume. Therefore, the Engine Having a Variable Compression Ratio 200 of the present disclosure takes full advantage of the available expansion volume of the engine and maximizes the overall expansion ratio whether the compression ratio is at its highest, at its lowest, or somewhere in between, thereby maximizing overall efficiency.

While the Engine Having a Variable Compression Ratio, and methods for the use thereof, has been described with respect to at least one embodiment, the engine and its method of use can be further modified within the spirit and scope of this disclosure, as demonstrated previously. This application is therefore intended to cover any variations, uses, or adaptations of the system and method using its general principles. Further, this application is intended to cover such departures from the present disclosure as come within known or customary practice in the art to which the disclosure pertains and which fall within the limits of the appended claims.

REFERENCE NUMBER LISTING

| | | | |
|---|---|---|---|
| 100 | (known) Compression ratio varying mechanism | 200 | Engine having a variable compression ratio |
| 102 | (known) Piston | 202 | Compression ratio varying mechanism |
| 104 | (known) Crankshaft | 204 | Piston |
| 106 | (known) Crankpin | 206 | Crankshaft |
| 108 | (known) Journal | 208 | Crankpin |
| 110 | (known) Crank arm | 210 | Crank arm |
| 112 | (known) upper link | 212 | First or upper link |
| 114 | (known) lower link | 212A | First or upper link connection to piston |
| 116 | (known) control link | 214 | Second or lower link |
| 118 | (known) control shaft | 214A | Second or lower link connection to crankpin |
| 120 | (known) control eccentric | 216 | Third or control link |
| 122 | (known) shaft control mechanism | 216A | Third or control link connection to lever |
| | | 216B | Connection between first or upper link, second or lower link, & third or control link |
| | | 218 | Lever arm |
| | | 220 | Lever pivot point |
| | | 222 | Lever control shaft |

What is claimed is:

1. A vehicle having an engine having a variable compression ratio, comprising:

a piston arranged within a cylinder;

a crankshaft having a crankpin offset from the centerline of the crankshaft;

a first or upper link having an upper end and a lower end, and being connected at its upper end to the piston;

a second or lower link having an upper end and a lower end, and being connected at its lower end to the crankpin and at its upper end to the lower end of the first or upper link;

a third or control link having a first end and a second end, and being connected at its first end to at least one of the lower end of the first or upper link and the upper end of the second or lower link;

a lever arm having a first end and a second end, and being connected at its first end to a lever control shaft, and being controlled in its orientation thereby about a pivot point at the first end;

the third or control link being connected at its second end to the second end of the lever arm;

the third or control link being substantially the same length as the lever arm; wherein;

the length of the of the crankpin offset from the centerline of the crankshaft, the length of the second or lower link, and the position of the lever control shaft relative to the position of the crankshaft being chosen so that the position of the connection between the third or control link, the first or upper link, and the second or lower link substantially coincides with the position of the lever control shaft when the piston and crankshaft are at the Bottom Dead Center (BDC) position; and wherein;

the Bottom Dead Center position of the piston remains substantially the same regardless of the compression ratio of the engine.

2. The vehicle of claim 1, wherein:

the position of the lever control shaft relative to the position of the crankshaft, and the orientation of the lever arm being chosen so that the position of the connection between the first or upper link, the second or lower link, and the third or control link that is substantially coincident with the position of the lever control shaft when the piston and crankshaft is at BDC is located to one side of the centerline of the crankshaft, and so that the connection between the third or control link and the lever arm is located to the other side of the centerline of the crankshaft.

3. The vehicle of claim 2, wherein:

the position of the lever control shaft relative to the position of the crankshaft and the orientation of the lever arm being chosen so that the connection between the third or control link and the lever arm extends vertically upwards of the vertical position of the lever control shaft, and so that when the position of the third or control link connection to the lever arm is raised, it moves closer to the centerline of the crankshaft and the angle between the first or upper link and the second or lower link is increased.

4. The vehicle of claim 1, wherein:

the lever control shaft being connected to a lever shaft control mechanism.

5. The vehicle of claim 4, wherein:

the lever shaft control mechanism being connected to at least one controller.

6. The vehicle of claim 1, wherein:

the centerline of the crankshaft being offset from the centerline of the cylinder.

7. A vehicle having an engine with a variable compression ratio, comprising:

a piston arranged within a cylinder;

a crankshaft having a crankpin offset from the centerline of the crankshaft;

a first or upper link having an upper end and a lower end, and being connected at its upper end to the piston;

a second or lower link having an upper end and a lower end, and being connected at its lower end to the crankpin and at its upper end to the lower end of the first or upper link;

a third or control link having a first end and a second end, and being connected at its first end to at least one of the lower end of the first or upper link and the upper end of the second or lower link;

a lever arm having a first end and a second end, and being connected at its first end to a lever control shaft, and being controlled in its orientation thereby;

the third or control link being connected at its second end to the second end of the lever arm; and the third or control link being substantially the same length as the lever arm; wherein the length of the of the crankpin offset from the centerline of the crankshaft, the length of the second or lower link, and the position of the lever control shaft relative to the position of the crankshaft being chosen so that the position of the connection between the third or control link, the first or upper link, and the second or lower link substantially coincides with the position of the lever control shaft when the piston and crankshaft are at the Bottom Dead Center (BDC) position; and wherein;

the Bottom Dead Center (BDC) position of the piston remains substantially the same regardless of the compression ratio of the engine.

8. The vehicle of claim 7, wherein:

the position of the lever control shaft relative to the position of the crankshaft, and the orientation of the lever arm being chosen so that the position of the connection between the first or upper link, the second or lower link, and the third or control link that is substantially coincident with the position of the lever control shaft when the piston and crankshaft is at BDC is located to one side of the centerline of the crankshaft, and so that the connection between the third or control link and the lever arm is located to the other side of the centerline of the crankshaft.

9. The vehicle of claim 8, wherein:

the position of the lever control shaft relative to the position of the crankshaft and the orientation of the lever arm being chosen so that the connection between the third or control link and the lever arm extends vertically upwards of the vertical position of the lever control shaft, and so that when the position of the third or control link connection to the lever arm is raised, it moves closer to the centerline of the crankshaft and the angle between the first or upper link and the second or lower link is increased.

10. The vehicle of claim 7, wherein:

the lever control shaft being connected to a lever shaft control mechanism.

11. The vehicle of claim 10, wherein:

the lever shaft control mechanism being connected to at least one controller.

12. The vehicle of claim 7, wherein:

the centerline of the crankshaft being offset from the centerline of the cylinder.

13. A method for varying the compression ratio of an engine in a vehicle, comprising the steps of:

arranging a piston within a cylinder;

providing a crankshaft having a crankpin offset from the centerline of the crankshaft;

connecting a first or upper link at its upper end to the piston;

connecting a second or lower link at its lower end to the crankpin and at its upper end to the lower end of the first or upper link;

connecting a third or control link at its first end to at least one of the lower end of the first or upper link and the upper end of the second or lower link;

connecting a lever arm at its first end to a lever control shaft, and controlling its orientation thereby;

connecting the third or control link at its second end to the second end of the lever arm;

configuring the third or control link to be substantially the same length as the lever arm; and arranging the length of the of the crankpin offset from the centerline of the crankshaft, the length of the second or lower link, and the position of the lever control shaft relative to the position of the crankshaft so that the position of the connection between the third or control link, the first or upper link, and the second or lower link substantially coincides with the position of the lever control shaft when the piston and crankshaft are at the Bottom Dead Center (BDC); wherein;

the Bottom Dead Center position of the piston remains substantially the same regardless of the compression ratio of the engine.

14. The method of claim 13, further comprising the steps of:

arranging the position of the lever control shaft relative to the position of the crankshaft, and the orientation of the lever arm so that the position of the connection between the first or upper link, the second or lower link, and the third or control link that is substantially coincident with the position of the lever control shaft when the piston and crankshaft is at BDC is located to one side of the centerline of the crankshaft, and so that the connection between the third or control link and the lever arm is located to the other side of the centerline of the crankshaft.

15. The method of claim 14, further comprising the steps of:

arranging the position of the lever control shaft relative to the position of the crankshaft and the orientation of the lever arm so that the connection between the third or control link and the lever arm extends vertically upwards of the vertical position of the lever control shaft, and so that when the position of the third or control link connection to the lever arm is raised, it moves closer to the centerline of the crankshaft and the angle between the first or upper link and the second or lower link is increased.

16. The method of claim 13, further comprising the steps of:

connecting the lever control shaft to a lever shaft control mechanism.

17. The method of claim 16, further comprising the steps of:

connecting the lever shaft control mechanism to at least one controller.

* * * * *